US005160021A

United States Patent [19]

Sibley et al.

[11] Patent Number: 5,160,021

[45] Date of Patent: Nov. 3, 1992

[54] LEAK-PROOF CYLINDRICAL CONTAINER FOR THE TRANSPORT OF DIAGNOSTIC SPECIMENS OR DANGEROUS SUBSTANCES

[76] Inventors: Barry Sibley, Site 16 A, Box 9, R.R. #1, Enfield Nova Scotia B0N 1N0, Canada; Aka L. Char, Apt. 315, 15 Langebrae Dr., Halifax N.S. B3M 3W5, Canada

[21] Appl. No.: 738,160

[22] Filed: Jul. 30, 1991

[51] Int. Cl.[5] ..... B65D 81/16; B65D 85/42

[52] U.S. Cl. ..... 206/204; 206/523; 206/589; 220/295; 215/332

[58] Field of Search ..... 206/204, 205, 528, 486, 206/538, 523, 588, 589; 215/332, 231; 220/295, 304, 293

[56] References Cited

U.S. PATENT DOCUMENTS

| | | | |
|---|---|---|---|
| 450,827 | 4/1891 | Martyn et al. | 215/332 |
| 871,588 | 11/1907 | Hinsberger | 215/332 |
| 1,550,302 | 8/1925 | Zarobsky | 220/295 |
| 1,713,090 | 5/1929 | Polascheck | 215/332 |
| 3,882,315 | 5/1975 | Soldan | 206/204 X |
| 4,027,777 | 6/1977 | Blanke, Jr. | 220/295 |
| 4,043,482 | 8/1977 | Brown | 220/307 |
| 4,240,547 | 12/1980 | Taylor | 206/204 |
| 4,872,563 | 10/1989 | Warder et al. | 206/523 X |
| 4,882,893 | 11/1989 | Spencer et al. | 53/449 |
| 4,884,684 | 12/1989 | Bernardin et al. | 206/204 |
| 4,964,509 | 10/1990 | Insley et al. | 206/523 X |
| 5,024,865 | 6/1991 | Insley | 206/204 X |

FOREIGN PATENT DOCUMENTS

| | | | |
|---|---|---|---|
| 787737 | 6/1968 | Canada | 206/25 |
| 798151 | 11/1968 | Canada | 206/27 |
| 942237 | 2/1974 | Canada | 226/90 |
| 1012492 | 6/1977 | Canada | 206/40 |
| 1244798 | 11/1988 | Canada | 206/46 |

*Primary Examiner*—Paul T. Sewell
*Assistant Examiner*—Jacob K. Ackun, Jr.
*Attorney, Agent, or Firm*—Schmeiser, Morelle & Watts

[57] ABSTRACT

A container for packaging vials containing diagnostic specimens, or the like, which are to be mailed or transported. The container includes an open-topped plastic cylinder with an integral bottom wall having an upper section of the sidewall which is of a reduced diameter and includes opposed outwardly projecting lugs for engaging complementary slots in a cylindrical cap for the container. The upper section of the sidewall further includes a radial groove which accommodates an elastic O-ring for providing a leak proof seal for the container. The cap slides over the upper section of the sidewall and sealingly engages the O-ring to provide a leak-proof seal. The container is further provided with an open celled plastic foam insert which die-cut to accommodate up to three vials. The advantage of the container is that an easily manufactured, inexpensive readily packed transport container is provided which is capable of passing the drop, puncture and leakage test set forth by the UN Committee of Experts on the Transportation of Dangerous Goods.

19 Claims, 2 Drawing Sheets

LEAK-PROOF CYLINDRICAL CONTAINER FOR THE TRANSPORT OF DIAGNOSTIC SPECIMENS OR DANGEROUS SUBSTANCES

TECHNICAL FIELD OF THE INVENTION

The present invention relates to a container for transporting vials which contain dangerous or infectious substances such as diagnostic specimens and the like.

BACKGROUND OF THE INVENTION

In accordance with modern medical practice and disease control, it is frequently necessary to transport diagnostic specimens or other dangerous, contaminated or infectious substances from one place to another. For reasons of economy, such specimens are often dispatched through the public mail service. It is well known that packages in transit are often subjected to abusive handling due to neglect, accident or circumstance. The outbreak of Hepatitis B, AIDS (Acquired Immune Deficiency Syndrome) and similar highly infectious diseases has raised public awareness of the hazard of transporting diagnostic specimens. Consequently, there is a requirement for an inexpensive, readily manufactured and reliable container for transporting vials of such substances, which container is easily handled and convenient to use.

Containers for the transport of diagnostic specimens are known. U.S. Pat. No. 4,882,893 which issued Nov. 28, 1989 to Spencer et al. describes a method, a container and a kit for the transport of diagnostic specimens. The kit includes a pressure vessel for accepting vials wrapped in shock absorbing material. The vessel is then wrapped in layers of cardboard, sealed in a plastic bag and subsequently sealed in a cardboard box, all of which materials are supplied in a kit. A disadvantage of this system is that the kit is relatively expensive to manufacture and, more seriously, very labour intensive to pack. A further disadvantage is that in order to provide an effective pressure seal, the pressure vessel must be manufactured to an exacting standard because the seal is dependent upon mating contact between an inner surface of a cap and a top edge of a sidewall of the pressure vessel.

It is an object of the present invention to provide a leak-proof cylindrical container for the transport of vials containing diagnostic specimens or dangerous substances which is inexpensive to manufacture.

It is a further object of the invention to provide a leak-proof container for the transport of vials containing diagnostic specimens or dangerous substances which is easily handled.

It is yet a further object of the invention to provide a leak-proof container for the transport of vials containing diagnostic specimens or dangerous substances which requires a minimum of labour to pack and seal.

SUMMARY OF THE INVENTION

The present invention provides a leak-proof container for the transport of vials containing diagnostic specimens or dangerous substances, which comprises an open-topped cylinder provided with a radial groove adjacent a top end of the cylinder for retaining an O-ring gasket, and a cap for the cylinder which includes a circular top wall and a depending skirt that is sized to slide over a top end of the cylinder and sealingly engage the O-ring gasket to provide a pressure sealed vessel. The container is also provided with quick release means for locking the cap to the cylinder. The quick release means is preferably a pair of opposed lugs located on the outer sidewalls of the cylinder, which lugs are spaced beneath the O-ring gasket, and a pair of opposed slots in the skirt of the cap, which slots are preferably an inverted L-shape to provide a twist lock between the cap and the cylinder. The cylinder is further provided with an absorptive insert which includes at least one socket for receiving a vial that contains a diagnostic specimen or the like. The at least one socket is positioned within the insert so that the vial is provided with a protective surround which prevents contact between the vial and the sides or bottom of the cylinder.

There is therefore provided a readily manufactured, inexpensive reusable leak-proof container for transporting diagnostic specimens and the like which provides the advantage of being quickly and simply packed while ensuring a secure shipping environment for hazardous substances. The advantages of the container include the fact that it is inexpensively manufactured because the O-ring gasket requires less tooling precision than sealing systems which rely on a precise mating engagement between a top rim of a container and an inner periphery of a cap. A cap is also quickly engaged and quickly released from the container, providing labour savings in handling same. In addition, the preformed absorptive liner provided with the container not only ensures that vials are packed with absolute efficiency but also ensures that the vials are provided with a very secure shock absorbing surround which substantially eliminates the possibility of breakage. Should breakage occur the absorptive insert readily absorbs and retains any liquid released from the vial(s) to ensure a spread of contamination is minimized.

BRIEF DESCRIPTION OF THE DRAWINGS

The preferred embodiment of the invention will now be further described by way of example only and with reference to the following drawings wherein.

DETAILED DESCRIPTION OF THE PREFERRED EMBODIMENT

Figure 1:
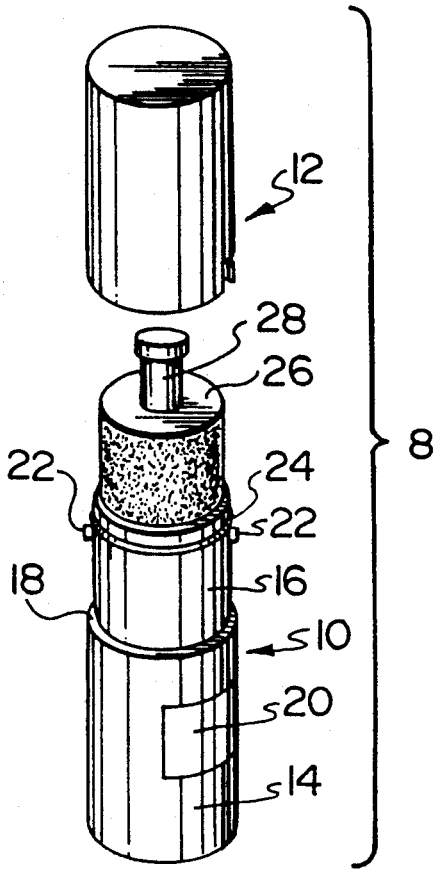
FIG. 1 is an exploded perspective view of a container in accordance with the invention, showing the container cap removed and a vial packed in the container.

As shown in FIG. 1 of the drawings, leak-proof container 8 for the transport of vials containing diagnostic specimens or dangerous substances, includes a cylinder generally indicated by the reference 10 and a cap generally indicated by the reference 12. The cylinder 10 includes a sidewall having a lower section 14 of a first circumference and an upper section 16 of a second, reduced circumference. The transition zone 18 between the lower section 14 and the upper section 16 is a square shoulder which is clearly visible in FIG. 2. The lower section 14 may optionally include a rectangular recess 20 for the attachment of a mailing label. If the area 20 is slightly recessed, the marginal edges of the area 20 help prevent self-adhesive mailing label from becoming detached in transit.

Figure 2:
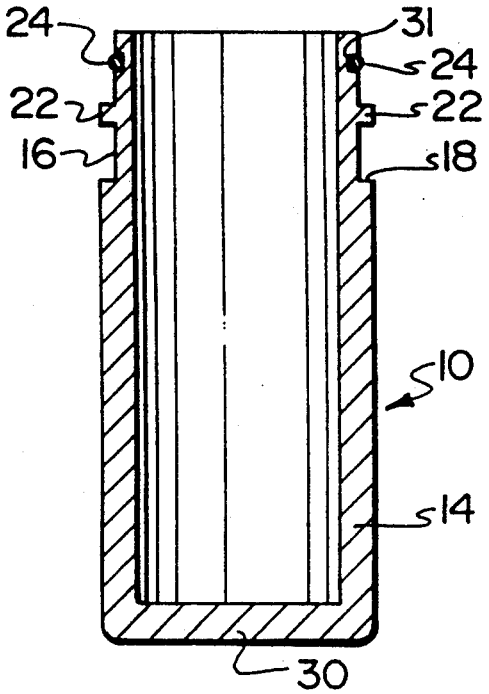
FIG. 2 is a cross-sectional view of a cylinder portion of the container shown in FIG. 1.

The upper section 16 of the cylinder 10 further includes an opposed pair of closure lugs 22 and an O-ring 24 for providing a leak-proof seal between the cylinder 10 and cap 12, as will be explained in more detail in reference to FIG. 2.

The container 8 further includes an absorptive insert 26 which provides a cushioned surround for a vial 28 in which diagnostic specimens or the like are stored. As shown in FIG. 2, the cylinder 10 is preferably a thick walled injection molded thermoplastic cylinder having a sidewall which includes a lower section 14 and an upper section 16. The cylinder 10 further includes an integral bottom wall 30. As noted above, the cylinder 10 is preferably injection-molded using an impact resistant thermo-plastic such as a high molecular weight, high density polyethylene. The upper section 16 of the sidewall includes a radial groove 31 which accommodates an elastic O-ring 24, preferably manufactured from neoprene or ethylene propylene. The opposed closure lugs 22 are the male components of a twist lock closure which facilitates opening and closing the container while providing a secure closure that is very resistant to unintentional release.

Figure 3:
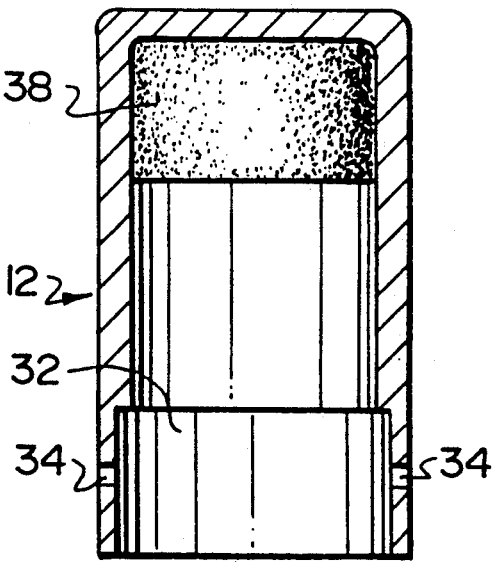
FIG. 3 is a cross-sectional view of a cap portion of the container shown in FIG. 1.

FIG. 3 shows a cross-sectional view of cap 12 which is likewise preferably injection molded from an impact resistant thermoplastic, particularly a high molecular weight, high density polyethylene. The cap includes a barrel region 32 which is sized to slide over the upper section 16 of cylinder 10. The barrel region 32 has opposed slots 34 in a bottom edge for slidably receiving the lugs 22 on cylinder 10. The cap 12 preferably includes an absorptive foam plug 38 for providing protective cushion in the top of the container 8. The foam plug 38 also provides an absorptive reserve for the container 8.

Figure 4:
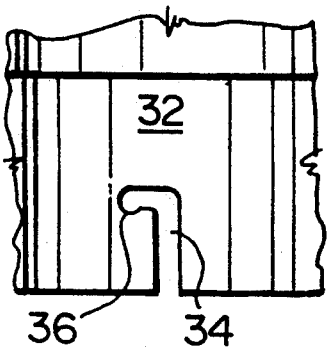
FIG. 4 is fragmentary elevational view of the circled portion shown in cross-sectional view in FIG. 3.

FIG. 4 shows a fragmentary elevational view of a slot 34. As is apparent, the slot 34 has an inverted L-shape which terminates in a circular arc 36. The circular arc 36 at the terminus of groove 34 inhibits the unintentional release of cap 12 from cylinder 10.

Figure 5:
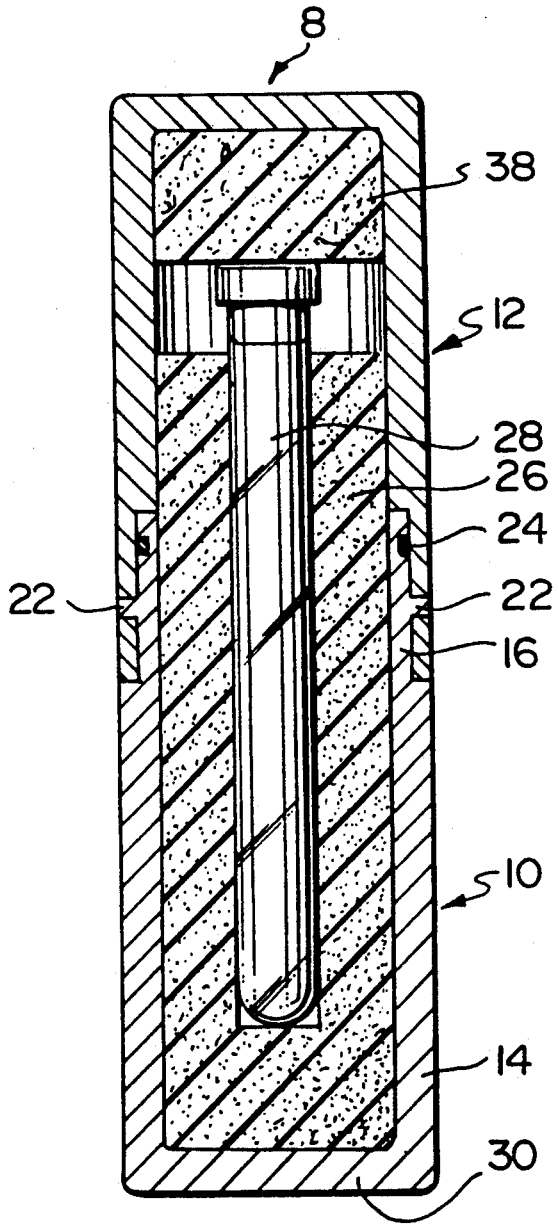
FIG. 5 is a cross-sectional view of the container shown in FIG. 1, inclusive of the cap which is shown in a closed condition.

FIG. 5 shows in cross-section a typically packed container 8. The container 8 includes an absorptive insert 26 for supporting a vial 28, which typically contains a diagnostic specimen.

The insert 26 is conveniently and preferably manufactured from an open-celled polyurethane foam which is die-cut, in a manner well known in the art, to fit snugly within cylinder 10 and provide a snug cushioned surround for vial 28. The open-celled foam 26 readily absorbs liquid and will therefore contain any fluid in vial 28 should the vial 28 rupture for any reason. Insert 26 may have more than one die-cut socket 36 so that the container can accommodate two ten (10) ml vials or three five (5) ml vials. The container may, of course, be enlarged so that practically any number of vials are accommodated, but 1 to 3 vials per container are generally preferred since 1 to 3 vials are usually adequate for a full complement of specimens for a patient. The absorptive insert 26 is readily removed and replaced by another insert if a container which accommodates a different number of vials is desired. It is therefore apparent that the container in accordance with the invention is readily adapted to a particular need.

A container in accordance with the invention was subjected to impact, puncture and leakage tests prescribed by the United Nations Committee of Experts on the Transportation of Dangerous Goods. In accordance with these tests, a container containing a glass vial filled with test liquid was permitted to free-fall thirty-two feet (approximately 10 meters) onto a concrete surface. Neither the container nor the vial were damaged. In accordance with the test for puncture resistance, a stainless steel rod having a bullet-shaped end and weighing sixteen pounds (approximately 7.25 kilograms) was released from a height of 40 inches (or approximately 1.08 meters) and permitted to strike respectively the dead-center of each of the cap 12, the bottom wall 30 of cylinder 10, and the opposed sides of each of cap 12 and cylinder 10. The vial 28 was not damaged during the puncture test. Finally, a leak resistance test was conducted wherein the container was placed in a tray containing a fifty per cent (50%) mixture of ethylene glycol and ordinary tap water. The capsule was submersed in this solution and placed inside a vacuum chamber that was evacuated to a gauge reading of −97 kPa, which pressure was maintained for a period of more than ten minutes. No leakage of fluid into the container nor fluid from the vile 28 was observed.

It is apparent from the above that the instant invention provides a simple, efficient and safe container for transporting vials containing diagnostic specimens or the like. In fact, the container in accordance with the invention is predictably suitable for transporting many different dangerous substances, the full range of uses having not yet been fully explored.

The preferred embodiment hereinbefore described is intended to be exemplary only, the scope of the invention being defined solely by the scope of the appended claims.

We claim:

1. A leak-proof container for the transport of at least one vial containing diagnostic specimens, comprising:

a cylinder which includes a circular bottom wall and a sidewall integral with the bottom wall;

a cap which includes a circular top wall and a depending skirt that is sized to slide over the sidewall of the cylinder;

a radial groove in an outer surface of the sidewall that is spaced beneath a top edge of the sidewall and sized to retain an O-ring gasket for providing a pressure seal between the cylinder and the cap;

means for mechanically affixing the cap to the cylinder in a selectively releasable relationship, said means including at least one male part located on one of the cylinder and the cap and at least one female part located on a complementary region of the other of the cylinder and the cap, said one of a male part and a female part being located beneath the groove in the cylinder with respect to the top edge thereof; and an absorptive insert sized to fit within the cylinder and support the at least one vial for diagnostic specimens and the like in a cushioned relationship spaced away from the bottom wall and the sidewall of the cylinder.

2. A leak-proof container for the transport of at least one vial containing diagnostic specimens comprising:

an open-topped cylinder which includes a bottom wall and a sidewall integral with the bottom wall;

at least two spaced-apart lugs which extend from the sidewall in an orthogonal relationship therewith, said lugs being located adjacent a top edge of the sidewall;

a radial groove in the sidewall spaced beneath the top edge of the sidewall and above the at least two lugs, said groove being shaped to accommodate an O-ring gasket;

a cap which includes a circular top wall and a depending skirt which is sized to slide over the sidewall and sealingly engage the O-ring gasket in the groove, a bottom edge of the depending skirt including slots for accepting the lugs to removably secure the cap to the main body portion; and an absorptive insert which is sized to fit closely within the cylinder, said insert including at least one axial socket for receiving the at least one vial, said socket having an open top end and a closed bottom end which is spaced above the bottom wall of the cylinder.

3. A leak-proof container for the transport of at least one vial containing a diagnostic specimen, comprising:

a cylinder which includes a bottom wall and a sidewall that is integral with the bottom wall, said sidewall having a lower section with an outer surface of a first circumference, an upper section with an outer surface of a second, reduced circumference and an inner cavity of substantially constant diameter;

the outer surface of the upper section including a radial groove for accommodating an O-ring gasket which is spaced below a top edge thereof, and at least two spaced-apart outwardly projecting lugs which are respectively spaced-below the radial groove with respect to the top edge of that section;

a cap which includes a circular top wall and a depending skirt that is sized to fit over the upper section of the cylinder so that an inner surface of the skirt sealingly engages the O-ring gasket to provide a substantially leak-proof seal between the cylinder and the cap, and a bottom edge of the cap further includes at least two slots having an inverted L-shape for slidably receiving the at least two lugs on the cylinder, said slots terminating in a circular arc shaped enlargement to inhibit the unintentional removal of the cap from the cylinder; and an absorptive insert sized to fit within the cylinder, said insert including at least one open-topped axial socket for receiving a vial, the at least one socket providing a cushioned surround for at least the bottom and a substantial portion of the sidewall of the at least one vial.

4. The leak-proof container as recited in claim 1 wherein the cylinder and the cap are constructed from an impact resistant plastic.

5. The leak-proof container as recited in claim 2 wherein the cylinder and the cap are constructed from an impact resistant plastic.

6. The leak-proof container as recited in claim 3 wherein the cylinder and the cap are constructed from an impact resistant plastic.

7. The leak-proof container as recited in claim 1 wherein the cylinder and the cap are constructed from a high molecular weight, high density polyethylene.

8. The leak-proof container as recited in claim 2 wherein the cylinder and the cap are constructed from a high molecular weight, high density polyethylene.

9. The leak-proof container as recited in claim 3 wherein the cylinder and the cap are constructed from a high molecular weight, high density polyethylene.

10. The leak-proof container as recited in claim 1 wherein the absorptive insert is an open-celled plastic foam.

11. The leak-proof container as recited in claim 2 wherein the absorptive insert is an open-celled plastic foam.

12. The leak-proof container as recited in claim 3 wherein the absorptive insert is an open-celled plastic foam.

13. The leak-proof container as recited in claim 1 wherein the absorptive insert is an open-celled polyurethane foam.

14. The leak-proof container as recited in claim 2 wherein the absorptive insert is an open-celled polyurethane foam.

15. The leak-proof container as recited in claim 3 wherein the absorptive insert is an open-celled polyurethane foam.

16. The leak-proof container as recited in claim 1 wherein the means for mechanically attaching the cap to the cylinder comprises a connector wherein the cylinder includes two opposed cylindrical male lugs which respectively extend in an orthogonal relation from opposite sides of the cylinder and are spaced beneath the radial groove, and the cap includes inverted L-shaped female slots in the depending skirt which slots are sized to slidably accept the male lugs for releasably locking the cap on the cylinder.

17. The leak-proof container as recited in claim 1 wherein the container further includes an absorptive foam plug in a top of the cap to provide a protective cushion in a top of the container.

18. The leak-proof container as recited in claim 2 wherein the container further includes an absorptive foam plug in a top of the cap to provide a protective cushion in a top of the container.

19. The leak-proof container as recited in claim 3 wherein the container further includes an absorptive foam plug in a top of the cap to provide a protective cushion in a top of the container.

* * * * *